United States Patent [19]

Braga

[11] 4,411,041

[45] Oct. 25, 1983

[54] SILVER-PLATED TOOTH BRUSH

[76] Inventor: Renato Braga, Via Ozanam, 4, Milano, Italy

[21] Appl. No.: 241,461

[22] Filed: Mar. 3, 1981

[30] Foreign Application Priority Data

Dec. 4, 1980 [IT] Italy ..... 26430 A/80

[51] Int. Cl.[3] ..... A46B 9/04

[52] U.S. Cl. ..... 15/167 R; 15/176; 422/28; 604/265

[58] Field of Search ..... 15/176, 159 R, 145, 15/167 R; 128/10, 12, 15; 604/265; 204/23, 46 R, 150; 422/28, 29, 22

[56] References Cited

U.S. PATENT DOCUMENTS

| | | | |
|---|---|---|---|
| 935,493 | 9/1909 | Gramm et al. | 15/176 |
| 1,526,644 | 2/1925 | Pinney | 204/23 X |
| 2,216,333 | 10/1940 | White et al. | 422/28 X |
| 2,471,855 | 5/1949 | Bird | 15/176 |
| 2,927,052 | 3/1960 | Mourdry | 422/22 X |
| 4,054,139 | 10/1977 | Crossley | 604/265 |

FOREIGN PATENT DOCUMENTS

| | | | |
|---|---|---|---|
| 889135 | 9/1953 | Fed. Rep. of Germany | 15/176 |
| 2161589 | 6/1973 | Fed. Rep. of Germany | 15/176 |
| 2434268 | 1/1976 | Fed. Rep. of Germany | 15/176 |
| 656916 | 9/1951 | United Kingdom | 15/176 |
| 992302 | 5/1965 | United Kingdom | 15/176 |

*Primary Examiner*—Peter Feldman
*Attorney, Agent, or Firm*—Michael J. Striker

[57] ABSTRACT

Silver-plated tooth brush comprising the brush head and the handle, fixed together by a moveable connection to enable silver-plating to be done to the head only, and to make it interchangeable. The brush head, including the holes in which the tufts of the bristles are fitted, is entirely coated with a layer of silver whose bactericidal properties, when contacted with water, are transferred by the water to the bristles by the ions of silver possessed within the silver.

1 Claim, 6 Drawing Figures

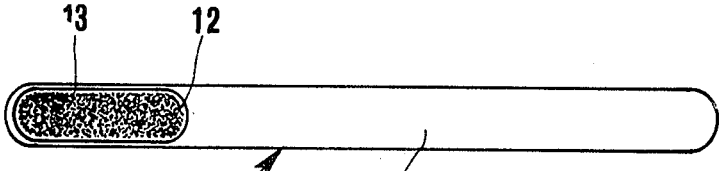
FIG.1
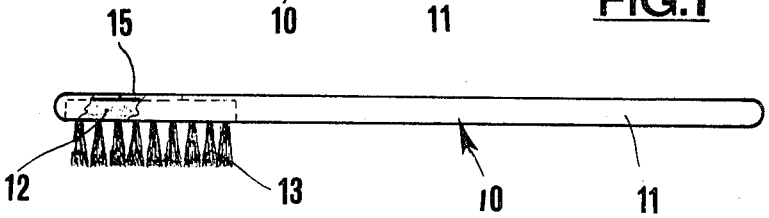
FIG.2
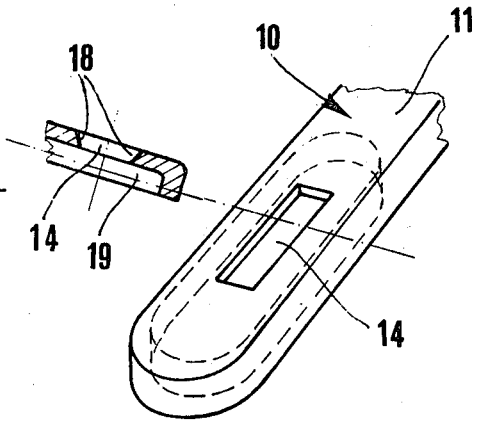
FIG.4
FIG.3
FIG.5
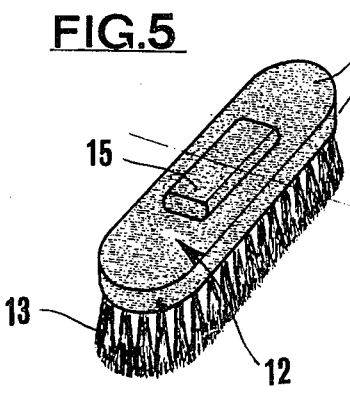
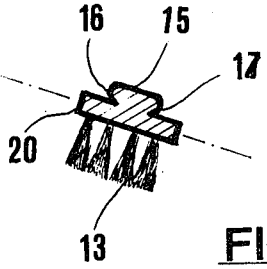
FIG. 6

SILVER-PLATED TOOTH BRUSH

BACKGROUND OF THE INVENTION

The ordinary tooth brush, generally consisting of one single piece made of plastic or similar material, is known to all.

One of its main drawbacks is the difficulty of ensuring thorough cleanliness, especially in the spaces between the bristles, which fact lowers the level of hygiene and favours formation of bacteria—consequently creating a risk of infection in the oral cavity, even of a serious nature, and of gum infection in particular.

SUMMARY OF THE INVENTION

It is an object of this invention to eliminate the aforementioned drawbacks and in addition to offer considerable advantages as will be explained below.

The two essential parts—handle and brush—are made in two pieces, generally of plastic, and can be easily put together and taken apart by the user. On the back of the brush head there is an upstanding projection so shaped as to fit closely into a cut-out made to take it in the handle, the two parts thus remaining firmly held together by pressure between them.

One end of the head being close to the handle, when replacement becomes necessary, the head can be easily detached from the handle by finger pressure.

The upstanding projection on the back of the brush head consists of a small block-shaped piece which is slightly wider at the sides so that, when pushed into place in the handle, lateral pressure holds it in position.

Alternatively, the "male" part could be made on the handle and the "female" part cut out of the head.

The handle contains the entire head in a specially made cavity in such a way as to establish satisfactory continuity both from the aesthetic and functional points of view. Before application of the bristles, the head is electroplated with substantially pure silver several microns thick. Alternatively, the entire tooth brush could be silver plated.

The characteristics of the invention and its aims will be made still clearer by the example of how it can be made illustrated in the sketches.

BRIEF DESCRIPTION OF THE DRAWINGS

FIG. 1 shows a tooth brush seen from the front, according to the invention

FIG. 2 shows a tooth brush seen from the side;

FIG. 3 is a top perspective view of the front end of the handle;

FIG. 4 is a partial cross section of the handle;

FIG. 5 is a perspective view of the brush head; and

FIG. 6 is a cross section of the head shown in FIG. 5.

DETAILED DESCRIPTION OF THE PREFERRED EMBODIMENTS

The toothbrush 10 is composed of the handle 11 and of the head 12 with its bristles 13. The small block 15 is fixed to the back of the head.

A cavity 14 is cut in the front end of the handle and is so shaped as to accept the block 15 which (as shown in FIG. 6) has convexly curved sides 16, 17. As shown in FIG. 4, the sides 18 of the cut-out 14 diverge outwards while the dimensions of the cavity 19 are adequate to house the whole of the brush head.

Before the bristles are fitted into holes in the head, the head undergoes an electro-plating process during which the head, including the sides of the holes, is entirely coated with a layer 20 of substantially pure silver of several microns thickness. Thus, sterilization action is provided at the base of the bristles, between the sides of the holes and the bristles, and within the spaces among the base of the bristles.

Operational principles of the invention are clear.

When, by exerting a slight amount of pressure, the brush head enters its cavity 19 the projecting block 15 snaps into the cut-out 14 made for it so that the two parts fit together in a sufficiently stable manner while the toothbrush is being used.

To expell the brush head, all that is needed is to apply adequate pressure, with the fingers or something else to the back of block 15.

ADVANTAGES OFFERED BY THE INVENTION

Improved defences against infection of the oral cavity. A notably high degree of hygiene, in spite of the difficulty of cleaning properly between the bristles, conferred by the properties of silver, which, by its very nature, is refractory to the efforts of bacteria to remain on it and proliferate, as well as to dirt generally thus ensuring the best possible level of cleanliness. In addition there is the added "value" given to the brush by the properties which silver possesses being at one and the same time ornamental, undeteriorable and hard-wearing.

As the tooth brush is made in two parts, only the head need be silver-plated or in any case only that part which holds the bristles, enabling economy to be made in its manufacture and making it possible for the user to effect easy replacement.

As the applications of the invention have been described only as an example, in no way limiting them to this, it is understood that any equivalent application of the inventive concepts expressed and any product made and/or operating in accordance with the characteristics of the invention, will be included within its field of protection.

I claim:

1. A toothbrush comprising a handle and a head having a surface and fitted with bristles, at least that part of the head's surface which carries the bristles being coated with silver whose bactericidal properties, when contacted with water, are transferred by the water to the bristles by the ions of silver possessed within the silver, wherein the silver coating is applied before insertion of the bristles, said coating being also applied to the sides of the holes in which the tufts of the bristles are fitted to provide a sterilization action on the bristles and within the spaces among the base of the bristles, and between the sides of said holes and the bristles in such a way as to avoid proliferation of bacteria on the bristles from their base portions to the tips thereof.

* * * * *